US005161711A

United States Patent [19]

Picozza et al.

[11] Patent Number: 5,161,711

[45] Date of Patent: Nov. 10, 1992

[54] CLOSURE ASSEMBLY WITH SEPARABLE SEAL

[75] Inventors: Augusto A. Picozza, Orlando, Fla.; Masao Kato; Tsuyoshi Minami, both of Okazaki, all of Japan

[73] Assignee: Dart Industries Inc., Deerfield, Ill.

[21] Appl. No.: 785,680

[22] Filed: Oct. 31, 1991

Related U.S. Application Data

[63] Continuation-in-part of Ser. No. 677,017, Mar. 28, 1991.

[51] Int. Cl.[5] ..... B65D 43/04

[52] U.S. Cl. ..... 220/282; 220/256; 220/307; 215/341; 215/364

[58] Field of Search ..... 220/254, 255, 256, 281, 220/282, 307; 215/364, 341

[56] References Cited

U.S. PATENT DOCUMENTS

| | | | |
|---|---|---|---|
| 1,901,155 | 3/1933 | Farber | 215/364 |
| 2,333,117 | 11/1943 | Nyoen | 220/282 |
| 2,705,573 | 4/1995 | Zepelovitch | 215/364 X |
| 3,059,798 | 10/1962 | Darmstadt et al. | 215/364 X |
| 3,337,077 | 8/1967 | Wheaton, Jr. | 220/256 X |
| 3,570,703 | 3/1971 | MacRae | 220/256 |
| 3,628,686 | 12/1971 | Burton et al. | 215/364 X |
| 3,638,821 | 2/1972 | Guala | 215/364 X |
| 3,741,431 | 6/1973 | Burdick | 220/282 |
| 3,995,766 | 12/1976 | Fralick | 220/282 |
| 4,356,930 | 11/1982 | Roper | 220/306 |
| 4,377,236 | 3/1983 | Montgomery | 220/282 X |
| 4,526,797 | 7/1983 | Stone, Jr. | 220/256 X |
| 4,619,373 | 10/1986 | Galer | 220/354 |
| 4,667,843 | 5/1987 | Galer | 220/354 |
| 4,807,778 | 2/1989 | Lo | 220/282 |
| 4,887,735 | 12/1989 | Dudzik | 220/307 |
| 4,905,861 | 3/1990 | Boxall et al. | 220/266 |
| 4,923,085 | 5/1990 | Lillelund et al. | 220/282 |
| 5,029,723 | 7/1991 | Lo | 220/282 |

FOREIGN PATENT DOCUMENTS

| | | | |
|---|---|---|---|
| 460171 | 10/1930 | Italy | 220/282 |

*Primary Examiner*—Stephen Marcus
*Assistant Examiner*—Vanessa Caretto
*Attorney, Agent, or Firm*—John A. Doninger

[57] ABSTRACT

A container closure comprising a rigid lid and a separably formed flexibly resilient seal mounted thereto. The lid includes a top panel with a depending annular flange. The seal includes a solid central panel with an upwardly directed integral flange peripherally thereabout and receiving the lid flange. The seal flange mounts opposed pivot points engageable with the upper edge of a container and defining a pivot axis. A positioning rib extends peripherally about the seal flange between the pivot points for seated engagement on the upper edge of the container.

18 Claims, 3 Drawing Sheets

CLOSURE ASSEMBLY WITH SEPARABLE SEAL

This is a continuation-in-part of application Ser. No. 07/677,017, filed Mar. 28, 1991 for CLOSURE ASSEMBLY FOR CONTAINERS, in the names of Robert H. C. M. Daenen; Stig Lillelund; Masao Kato; Peter Lonergan; and Augusto A. Picozza.

BACKGROUND OF THE INVENTION

U.S Pat. No. 4,923,085, issued May 8, 1990, and commonly assigned with the present application, sets forth in detail the general state of the art relating to container closures, and specifically defines a closure system utilizing a rocking lid with a depending flange which directly seals to the open mouth of a container. The lids to which the patent is directed are generally intended for use on relatively large-mouthed containers of the type normally found in the kitchen for the storing of foodstuffs. As such, and as the opening of the lid is effected by a physical rocking or pivoting of the lid about fulcrum points, the lid itself must be of a substantially rigid construction, formed for example of a polycarbonate or polystyrene. The container will preferably be formed of a similar rigid material for appropriate support of the contents.

The sealing normally achieved between the rigid container and the rigid locking lid has been found to be effective for general purposes if close manufacturing tolerances are maintained. However, a more effective sealing is frequently desired or in fact found to be necessary for a variety of products and related storing conditions.

This necessity for a more effective sealing of the lid to the container, while maintaining the highly desirable rocking nature of the lid, gives rise to a substantial problem. Basically, if a softer plastic material such as low-density polyethylene or polypropylene is used to form the lid, it is possible a more intimate seal will be achieved. However, the lid will no longer possess the high degree of rigidity needed to effect the essential rocking movement thereof to allow for an opening of the lid through pressure at a designated point thereon. Rather, the flexible lid, as with known lids of a highly flexible nature, would have to be peripherally peeled form the container by the fingers grasping the edge of the lid peripherally thereabout. As such, the distinct advantages derived from the provision of a rocking lid would not be achieved.

The application parent to the present application proposes a solution to the problem of effectively sealing a rocking closure to and within the mouth of a companion container by providing, in several embodiments, a closure assembly comprising a rigid pivotable lid to which is mounted a separately molded flexible or low-density seal member. The seal member, upon a mounting of the closure assembly to a container, provides the desired effective seal between the rigid lid and rigid container while retaining the advantages of a rocking closure, including the effortless removal thereof.

SUMMARY OF THE INVENTION

The present invention enhances the effectiveness of the seal, and hence the entire closure assembly by means of unique structural modifications which peripherally stabilize the seal in sealing engagement with the container mouth, provide for a more positive seating of the closure on the container, provide for an accommodation of internal pressures within the container both as the closure is mounted and removed, provide for a simplified means for disengaging the seal from the lid for cleaning, replacement, or the like, and provide other advantages inherent in the structural features of the seal and lid assembly.

The lid of the closure of the invention, formed of an appropriate rigid synthetic resinous material, for example a polycarbonate of polystyrene, includes a generally planar top panel with a continuous flange integral therewith and depending from the under surface thereof in inward spaced relation to the outer periphery of the top panel. The flange includes a continuous projection about the outer surface thereof in slightly spaced relation below the under surface of the top panel for sealing engagement with a mating lip or recess in the seal upon an assembly of the seal member to the lid. The lid flange also includes an alignment notch therein.

The seal or seal member is of a flexibly resilient material such as low-density polyethylene or polypropylene capable of intimately conforming to both the rigid lid and the rigid rim portion or mouth of the container.

The seal includes a bottom panel with an integral peripheral flange projecting upwardly therefrom. This flange includes a continuous inwardly directed lip at the upper edge thereof adapted to receive, through a snap-engagement, the lid flange projection therebelow for a releasable locking of the seal to the lid. A continuous groove or recess immediately below the lip can be provided for engagement of the lid projection therein. An alignment lug or protuberance extends inward from the seal flange for reception within the complementary notch in the lid flange for an alignment of the seal and lid. This alignment is preferred in that the upper surface of the lid will normally be provided with indicia or the like indicating the point of finger pressure to rock the lid, which in turn must be properly positioned relative to the actual means on the seal which provide for the rocking movement.

The seal flange, continuously about the outer periphery thereof and generally below the vertical center line thereof, is provided with a sealing projection which is so positioned and configured as to nest below a complementary downwardly directed shoulder within and about the container mouth. The sealing projection and container mouth shoulder are so defined as to provide for a snapping engagement of the closure into position, principally through a slight flexing of the seal or seal flange.

A positioning rib is integrally formed with and projects outwardly from the outer surface of the seal flange peripherally about a major portion thereof and at a height generally centrally between the sealing projection and the free upper edge of this flange. The desired rocking of the closure is effected about a pivot axis defined by the opposed end portions of the positioning rib and pivot lugs formed thereat and projecting upwardly therefrom to the upper edge of the seal flange.

The positioning rib is so located as to seat on the upper edge of the container with the closure fully inserted into sealing position within the container mouth. The rib thus allows for a positive seating of the closure on the container in a stable sealed position. In addition, the provision of this rib provides a convenient means for grasping the seal and peeling the seal away from the lid for cleaning, replacement or the like. When the closure is to be rocked open, a downward pressure is applied to the upper surface of the lid generally centrally along the minor arc defined between the opposed ends of the rib with the closure pivoting about a pivot axis defined between the rib ends.

The seal panel, in the preferred embodiment, is slightly upwardly domed and includes a central post or projection extending between the seal panel and the overlying lid panel to maintain a space therebetween and prevent a collapsing of the seal against the lid as might otherwise result from a partial internal vacuum created therebetween as the seal and lid are pressed into engagement with each other or as the closure itself is pressed into engagement with the container. The curvature of the seal, particularly if slightly downwardly stressed or flexed by engagement of the central projection against the overlying lid panel, tends to urge the peripheral seal flange outwardly, thus enhancing the intimate engagement of the seal flange with the container mouth portion. Further, the inherent slight degree of flexibility available in the seal panel allows for a movement thereof so as to accommodate pressure variations as the closure is applied and, more particularly, as the closure is removed so as to reduce any effect of a partial internal vacuum in the container tending to resist removal of the closure.

Other features, objects and advantages of the invention will be noted as the invention is more fully hereinafter described.

DESCRIPTION OF THE PREFERRED EMBODIMENTS

Figure 1:
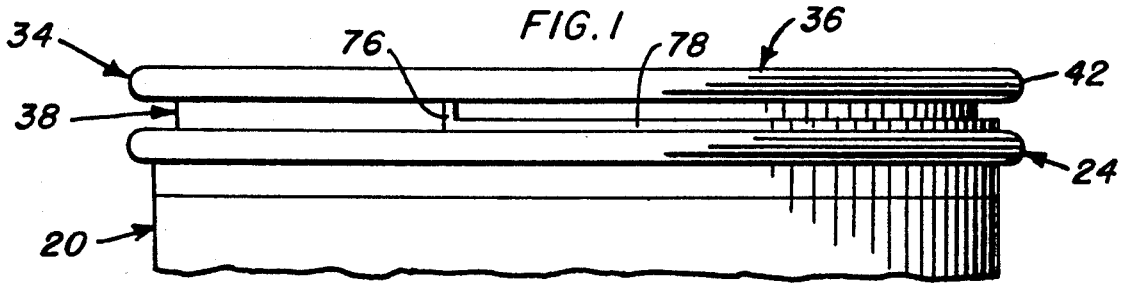
FIG. 1 is a side elevational view of a container with the closure of the present invention mounted thereon.

Referring more specifically to the drawings, the container 20, for purposes of illustration and description, has been presented as a cylindrical canister with an upwardly opening mouth 22 coextensive with the upper end of the canister and defined by a peripheral rim portion 24 either integrally molded with the canister wall or separately molded and intimately bonded thereto. As will be appreciated, the container can be of other configurations and the mouth relatively smaller than the full extent of the upper end of the container, for example being defined by the planar upper edge of a projecting pour spout. The container 20, along with the mouth-defining rim portion 24, is formed of a rigid plastic, for example a polycarbonate or polystyrene, with the rim portion 24 having a planar or substantially planar upper edge 26 and an inwardly directed peripheral lip or lip-like projection 28. The lip includes an inner face 30 inclined inward and down from upper edge 26 at approximately ten degrees to the vertical and terminating in a laterally extending downwardly directed arcuate shoulder 32 for enhanced frictional engagement and sealing of the closure or closure assembly 34 to the container 20.

The closure 34, while not limited thereto, has for purposes of illustration and description, also been presented as circular to conform to the cylindrical container. The closure comprises a rigid lid 36 of, for example, a polycarbonate or polystyrene, and a seal or seal member 38 of a flexibly resilient material such as low-density polyethylene or polypropylene which is capable of intimately conforming to both the container rim portion 24 and the lid 36.

The lid 36 includes a top panel 40, preferably generally planar as illustrated and with an outer periphery 42 which, upon a mounting of the closure 34, generally aligns with the rim portion 24 of the container 20. The lid 36 includes, in inwardly spaced relation to the lid periphery 42 an integral depending annular flange 44. The flange 44 is interrupted, along the continuous extent thereof, by an alignment notch 46 extending upwardly from the lower edge of the flange 44. In addition, and as a means for releasably securing the seal 38 to the lid 36, the outer surface of the lid flange 44, in closely spaced relation to the under surface of the lid panel 40, is provided with an annular projection 48, preferably with slightly tapered upper and lower faces to facilitate a snap locking of a corresponding component on the seal thereto in a manner to be explained subsequently.

Referring now to the seal 38, the seal 38 includes a circular panel 50 with an integral upwardly extending annular peripheral seal flange 52 thereabout. The diameter of the seal 38 is such as to snugly receive the lid flange 44 within the seal flange 52 in immediately adjacent relationship to the inner surface of the seal flange with the under surface of the top panel 40 of the lid resting on the continuous upper edge 54 of the seal flange 52.

Figure 9:
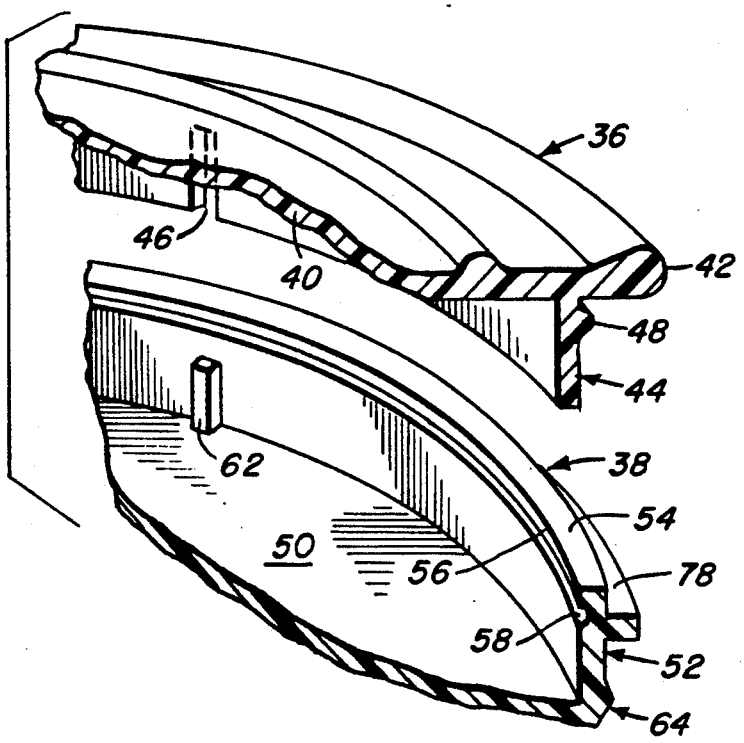
FIG. 9 is an exploded perspective detail of portions of the lid and seal of the closure assembly.

In order to releasably interlock the seal 38 with the lid 36, the inner surface of the seal flange 52, immediately adjacent the upper edge 54 thereof, is provided with an integral inwardly directed annular protrusion or lip 56 snap-engaged above the complementary lid flange protuberance 48 to seat within the defined groove between the protuberance 48 and the overlying lid top panel 40. It is contemplated that the relationship between the lid protuberance 48 and seal lip 56 be such as to define a liquid tight seal. Should a closer relationship be desired between the inner surface of the seal flange 52 and the outer surface of the lid flange 44, the seal lip 56 can be defined by an annular groove 58, as suggested in FIG. 9, within the inner surface of the seal flange to provide for a recessed reception of the lid protuberance 48.

As will be explained subsequently, it is particularly desirable that the lid and seal be aligned in a predetermined manner. Accordingly, an integral lug 62 extends upwardly from the panel 50 immediately adjacent the inner surface of the seal flange 52 at one point thereabout, this projection being complementarily configured for reception within the alignment slot 46 in the lid flange 44 to provide the desired alignment between the lid 36 and the seal 38.

The sealing between the seal 38 and the container 20 is effected between the outer surface of the seal flange 52 and the inner surface of the container at the upper or mouth end 22 thereof by means of a sealing projection 64 integral with and peripherally about the outer surface of the seal flange 52 in upwardly spaced relation to the lower edge thereof and generally below the mid height of the flange. This sealing projection includes tapered lower and upper faces 66 and 68 for a snap-like engagement of the closure with the annular inwardly projecting shoulder 32 on the container 20, and for a similar upward disengagement therefrom. In order to effect a more positive sealing of the closure 34 within the container 20, the apex of the sealing projection 64, as at 70, can be of a slightly bulbous configuration complementary and closely conforming to the arcuate configuration of the container shoulder 32 for a close surface-to-surface engagement therewith.

The desired rocking movement of the closure 34 to facilitate its removal is effected about a pivot axis 74 extending between a pair of opposed pivot points defined by pivot lugs 76 integral with and projecting outwardly from the outer surface of the sealed flange 52. The lugs 76 are on a chord of the circular closure which corresponds to the pivot axis 74 and divides the closure into a minor section and a major section. The pivot lugs 76 have upper ends at the upper edge 54 of the seal flange 52 and depend to approximately midpoint between this upper edge 54 and the sealing projection 64.

Upon a full seating of the closure 34 within the container mouth, the lower ends of the pivot lugs 76 seat on the upper edge 26 of the container, at which point the sealing projection 64 of the seal is snap-engaged with the container shoulder 32 and sealed therewith.

In order to stabilize the closure 34 in its sealed position within the container mouth, a positioning rib 78, integrally formed with and projecting from the outer surface of the seal flange 52, extends continuously between the lower ends of the lugs 76 about the arc of the major section defined by the chord between the pivot lugs 76. As illustrated, the lugs 76 are integral with the opposite ends of the rib 78 whereat the pivot points are defined. The lugs can in fact comprise up turned end portions of the rib.

With the closure 34 mounted within the container mouth, the positioning rib 78 seats on the upper edge 26 of the container about a major portion thereof corresponding to the major section of the closure between the opposed pivot lugs 76.

The positioning rib 78 has another and particularly significant function in providing a means for facilitating a disengagement of the seal 38 from the lid 36 as may be desired for cleaning of the two components of the closure assembly. This is effected by a grasping of the rib and the overlying edge portion of the lid, made possible by the parallel spaced relationship between the rib and lid edge portion, and peeling the seal from the lid. This avoids the necessity of having to pry off the lid by the insertion of a blade between the seal and lid as would be necessary were not a positive finger-engageable gripping means, as the rib 78, provided on the seal.

Figure 2:
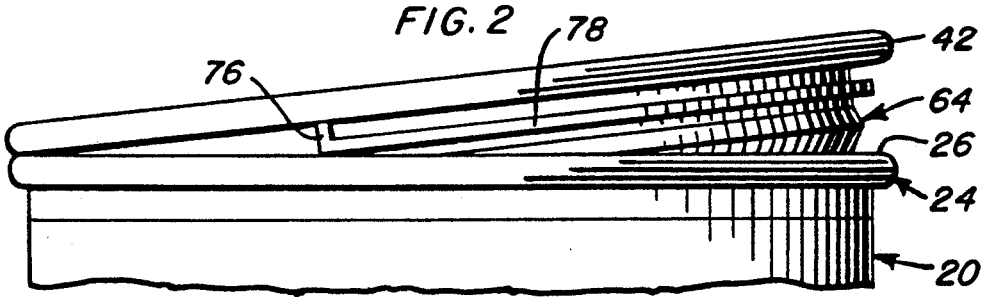
FIG. 2 is a side elevational view illustrating the closure in its upwardly rocked release or open position.
Figure 3:
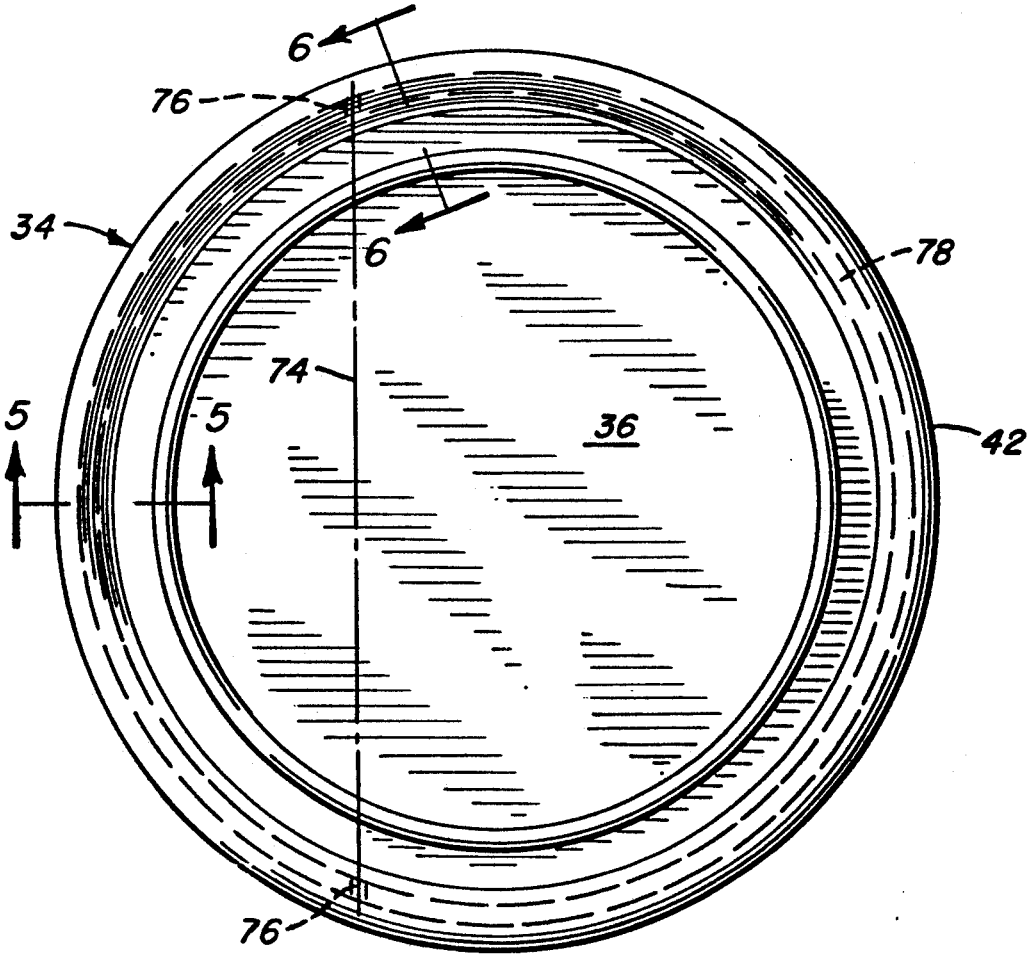
FIG. 3 is a top plan view of the container mounted closure.
Figure 4:
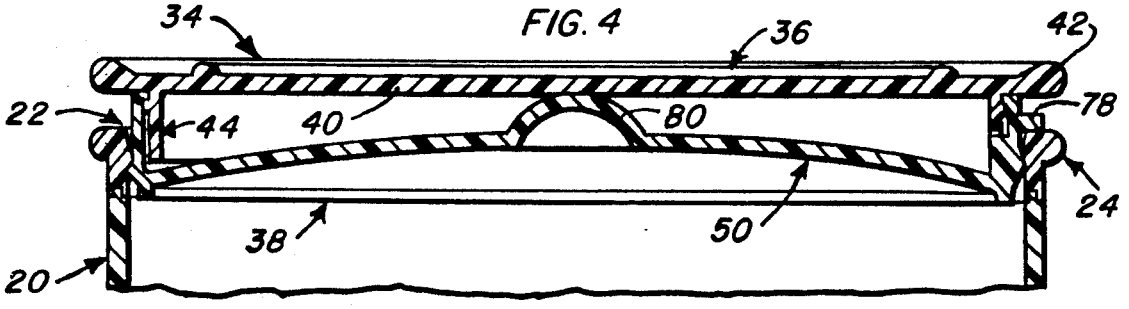
FIG. 4 is a transverse cross-sectional view through the container mounted closure.
Figure 5:
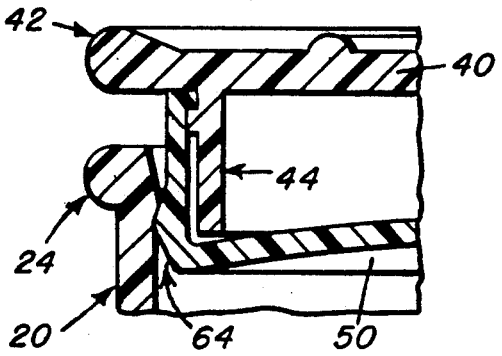
FIG. 5 is an enlarged cross-sectional view taken substantially on a plane passing along line 5—5 in FIG. 3
Figure 6:
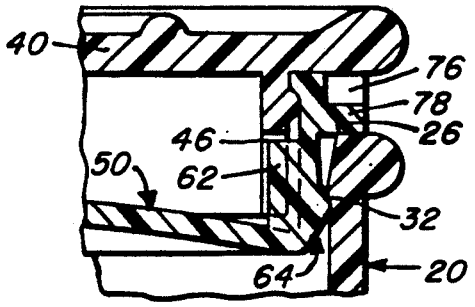
FIG. 6 is an enlarged cross-sectional view taken substantially on a plane passing along line 6—6 in FIG. 3
Figure 7:
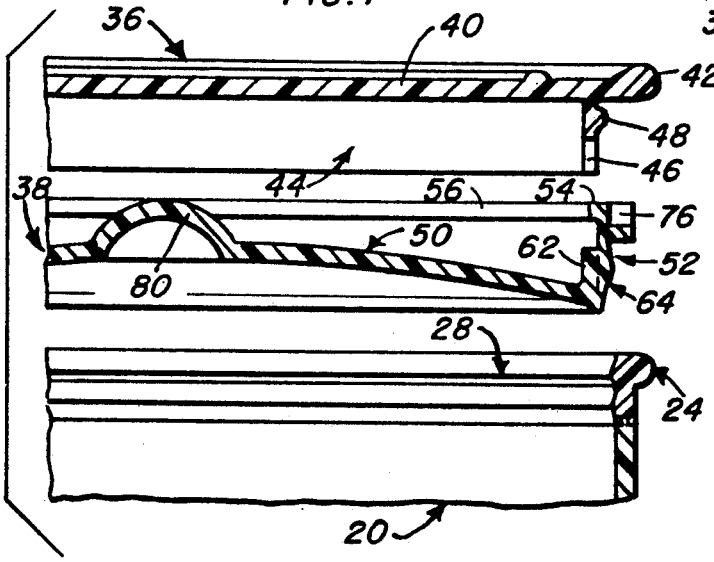
FIG. 7 is an exploded detail of the components of the closure and the upper portion of the container.
Figure 8:
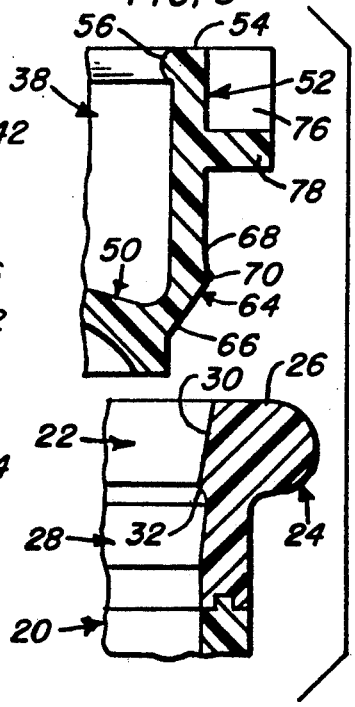
FIG. 8 is an enlarged exploded detail of the seal and the upper portion of the container.

The desired rocking of the closure 34 to initiate opening is effected by a downward pressure on the rigid lid 36 at a point, normally indicated by appropriate indicia, centrally along the arc of the minor section, that is the section opposed from the positioning rib 78. This downward pressure results in an upward disengaging movement of the major section by a pivoting of the closure about the pivot axis 74 defined by the aligned pivot lugs 76 as illustrated in FIG. 2. The closure, after being upwardly rocked, can be easily grasped by the fingers and removed from the container.

The bottom panel 50 of the seal 38 is slightly upwardly bowed or domed and incorporates a central upwardly projecting integrally formed dimple 80 adapted to centrally contact the overlying lid panel 40 to maintain a positive spacing between the seal panel 50 and lid panel 40. The domed configuration 50, peripherally integral with the lower edge of the annular seal flange 52 below the sealing projection 64 which seals to the container, stabilizes the seal flange at the point of sealing and provides for a positive outward biasing of the seal flange, particularly after the inherent slight inward flexing of this flange as the seal flange is seated within the container and below the complementary sealing shoulder 32 of the container.

The semi-hemispherical dimple or projection 80 also prevents the seal from collapsing inward when pressed, as during assembly of the closure components, and possibly creating a partial vacuum therebetween which would tend to bow the seal inwardly and diminish its effectiveness. Similarly, the seal panel 50, through its ability for limited resilient flexure, assists in the accommodation of pressure differentials between the interior and exterior of the container as the closure is both mounted and removed. Thus, and as an example, any tendency for the closure to "stick" to the container because of a partial internal vacuum in the container, is avoided.

Figure 10:
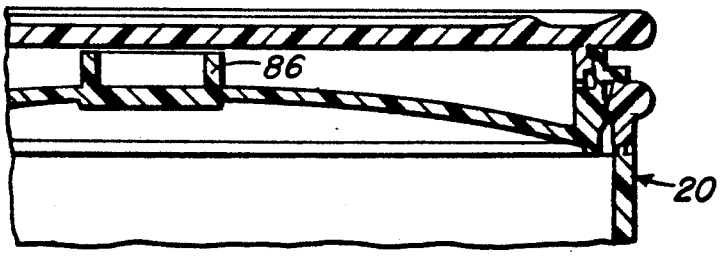
FIG. 10 is a cross-sectional detail of a modified form of closure.

Various modifications are contemplated within the parameters of the invention. For example, FIG. 10 illustrates a closure assembly wherein the central panel 50 of the seal, rather than incorporating the upwardly projecting dimple, includes a hollow cylindrical post 86 integrally formed with and projecting upwardly from the center of the panel 50.

Figure 11:
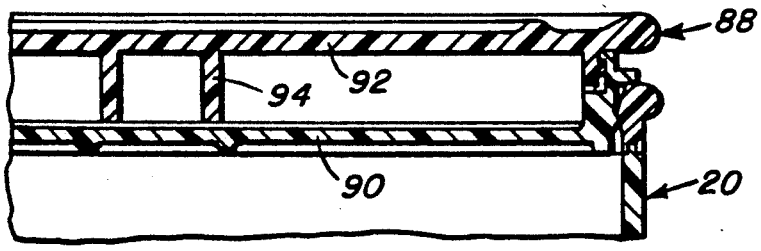
FIG. 11 is a cross-sectional detail of a further modified form of closure.

FIG. 11 illustrates a closure 88 wherein the seal panel 90 is planar, that is not centrally domed, with the space between the seal panel 90 and lid panel 92 being defined and maintained by a hollow tubular sleeve 94 integral with the under surface of the lid panel 92 and depending therefrom.

Figure 12:
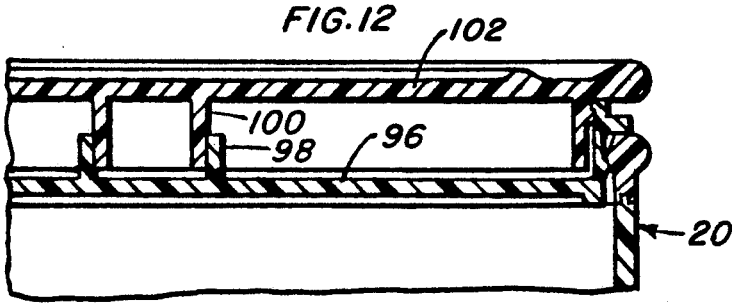
FIG. 12 is a cross-sectional detail of yet another modified form of closure.

FIG. 12 illustrates a variation of the construction of FIG. 11 wherein the planar or flat seal panel 96 is provided with a central integrally formed upwardly projecting hollow tubular socket 98 which receives and stabilizes the lower end of a hollow depending tubular sleeve 100 integral with the under surface of the lid panel 102.

As above indicated, the formation of the seal panel in an upwardly domed configuration is considered the preferred embodiment and, while generally similar advantages are provided by the planar panels of FIGS. 11 and 12, is considered to more effectively produce the desired results of an enhanced seal in conjunction with an accommodation of pressure variations and the like.

The foregoing is considered illustrative of the principals of the invention. Other variations and modifications may occur to those skilled in the art. As such, it is not desired to limit the invention to the exact constructions shown and described.

We claim:

1. A closure for selective reception within an open mouth of a container for sealing thereto, said closure comprising a rigid lid and a separately formed flexible seal, said lid including a top panel with an outer periphery, a lid flange integral with a depending from said top panel, said seal including a bottom panel with a peripheral seal flange integral with said bottom panel and projecting vertically upward therefrom peripherally thereabout, said lid flange being telescopically receivable within said seal flange, complementary means on said lid flange and said seal flange for releasably engaging each other and retaining said lid flange within said seal flange, said seal flange having an outer surface, an upper edge, and a lower edge, a pair of opposed pivot means integral with said outer surface of said seal flange and defining a pair of transversely aligned pivot points and a pivot axis, said pivot points being positioned between said upper edge and said lower edge of said seal flange, an elongate positioning rib integral with and projecting outwardly of said seal flange between said pivot points and to one side of the pivot axis for seating engagement on an associated container about a mouth of the container, and integral sealing means peripherally about said outer surface of said seal flange in vertically spaced relation below said rib for releasable sealing engagement within the container mouth.

2. The closure of claim 1 wherein, upon assembly, said seal panel and said lid panel define a space therebetween, and central projection means extending between said panels upon assembly, for a retention of the defined space.

3. The closure of claim 2 wherein said seal panel is upwardly domed and resiliently flexible so as to maintain an outward bias on said seal flange.

4. The closure of claim 3 wherein said central projection means is integrally formed with and projects vertically upward from said seal panel.

5. The closure of claim 2 wherein said seal panel is planar.

6. The closure of claim 5 wherein said central projection means is integrally formed with and depends from said lid panel.

7. The closure of claim 1 wherein said rib includes end portions extending vertically from said rib toward the upper edge of said seal flange and defining said pivot means.

8. The closure of claim 7 including cooperating alignment means on said lid and said seal for aligning said seal at a predetermined position on said lid.

9. The closure of claim 1 wherein said sealing means peripherally about said outer surface of said seal flange includes converging upper and lower surfaces terminating in a projecting substantially bulbous apex edge portion for sealing reception within a seat means of complementary configuration within a container mouth.

10. A closure for selective reception within an open container mouth for sealing thereto, said closure comprising a rigid lid and a separately formed flexible seal, said lid including a top panel with an outer periphery, a lid flange integral with and depending from said top panel, said seal including an imperforate bottom panel with a continuous peripheral seal flange projecting vertically upward therefrom, said lid flange being receivable within said seal flange for assembly of said seal to said lid, complementary means on said lid flange and said seal flange for releasably retaining said lid flange within said seal flange, a sealing projection integral with said seal flange an projecting therefrom peripherally thereabout for sealing engagement within a container mouth, said seal panel being integrally joined to said seal flange below said sealing projection and stabilizing said seal flange against inward movement to maintain sealing engagement of said sealing projection within a container mouth.

11. The closure of claim 10 wherein said seal panel is upwardly domed and resiliently flexible.

12. The closure of claim 11 including projection means centrally between said seal panel and said lid panel for maintaining a vertical space therebetween upon assembly of said seal to said lid.

13. The closure of claim 10 wherein said sealing projection include converging upper and lower surfaces terminating in a generally arcuate apex edge portion adapted to engage within a complementary arcuate seat means within the container mouth.

14. The closure of claim 10 including projection means centrally between said seal panel and said lid panel for maintaining a vertical space therebetween upon assembly of said seal to said lid.

15. The closure of claim 14 wherein said projection means between said seal panel and said lid panel is integrally formed with and projects vertically upward from said seal panel.

16. The closure of claim 14 wherein said projection means between said seal panel and said lid panel is integrally formed with and depends from said lid panel.

17. A container and a pivoting closure for use therewith, said container having an open mouth, said mouth having a planar peripheral upper edge, a sealing projection defined within said container mouth below the upper edge thereof, said projection including an inwardly and downwardly inclined upper surface terminating in a laterally outwardly directed arcuate shoulder, said shoulder presenting a downwardly and inwardly directed arcuate configuration; said closure including a rigid lid with a depending flange continuously thereabout, and a separately formed flexible seal received about and releasably mounted to said lid flange, said seal including an integral projection peripherally thereabout and releasably engageable with said container projection, said seal projection including converging upper and lower faces terminating in a slightly bulbous edge of a configuration complementary and closely conforming to the arcuate configuration of the shoulder for releasable surface-to-surface sealing engagement therein upon a mounting of said closure within said container mouth.

18. The container and closure of claim 17 wherein said lid includes a top panel and said seal includes a bottom panel, means maintaining said panels in vertically spaced relation to each other to define a space therebetween, said seal including and integral flange peripherally about said seal panel and projecting upwardly therefrom, said seal projection being defined on said seal flange, said seal panel maintaining said seal projection in engagement with said container mouth projection.

* * * * *